US006338647B1

(12) United States Patent
Fernandez et al.

(10) Patent No.: US 6,338,647 B1
(45) Date of Patent: Jan. 15, 2002

(54) LED VEHICULAR LIGHTS AND CONNECTORS THEREFOR

(76) Inventors: Robert Fernandez; Orion J. Super, both of 10301 NW. 108th Ave., Miami, FL (US) 33178

( * ) Notice: Subject to any disclaimer, the term of this patent is extended or adjusted under 35 U.S.C. 154(b) by 0 days.

(21) Appl. No.: 09/746,788

(22) Filed: Dec. 21, 2000

(51) Int. Cl.[7] ..... H01R 3/00
(52) U.S. Cl. ..... 439/490; 439/36
(58) Field of Search ..... 439/36, 35, 83, 439/643, 644, 646, 653; 362/214, 236, 249, 240, 494, 235, 80; 313/500

(56) References Cited

U.S. PATENT DOCUMENTS 3,335,389 A * 8/1967 Reichardt ..... 339/28
4,702,537 A 10/1987 Mattingly
4,936,789 A * 6/1990 Ugalde ..... 439/236
5,036,248 A * 7/1991 McEwan et al. ..... 313/500
5,062,027 A * 10/1991 Machida et al. ..... 362/80.1
5,409,398 A 4/1995 Chadbourne
5,564,943 A 10/1996 Weiss
5,594,433 A 1/1997 Terled
5,632,551 A * 5/1997 Roney et al. ..... 362/249
5,634,820 A * 6/1997 Vakil ..... 439/646
5,639,246 A 6/1997 Holmes
5,765,940 A 6/1998 Levy
5,766,020 A * 6/1998 Hughes ..... 439/35
5,807,122 A * 9/1998 Heeb et al. ..... 439/83
5,896,084 A 4/1999 Weiss
5,909,173 A * 6/1999 Mason et al. ..... 340/467
5,989,070 A 11/1999 Al-Turki
6,162,100 A * 12/2000 Al-Turki ..... 439/644

* cited by examiner

*Primary Examiner*—Gary Paumen
*Assistant Examiner*—P. Nguyen
(74) *Attorney, Agent, or Firm*—Alvin S. Blum

(57) ABSTRACT

Vehicular lights that hold a bulb in a bayonet type socket are converted to receive light emitting diode assemblies that plug in with a simple translation motion instead of the push and then twist required for bayonet type connection. An adapter is provided along with an installation tool. The adapter fits onto the tool. The tool is inserted into the bayonet socket by a push and twist motion. The tool is the removed by a straight pull. The adapter has now converted the socket so that it can receive and properly connect any of a group of LED assemblies by simple translation of a plug on the assembly. Various light assemblies are disclosed including incorporating the external vehicle lens, and including a sonic element in the assembly to complement a back-up light.

10 Claims, 2 Drawing Sheets

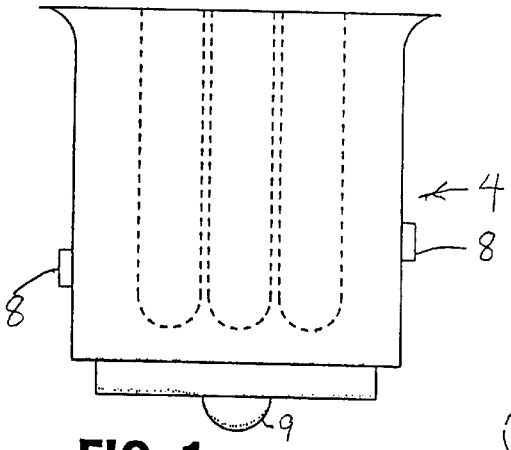
FIG. 1
FIG. 2
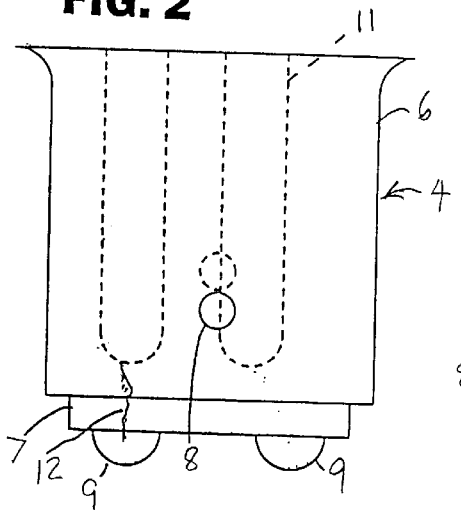
FIG. 3
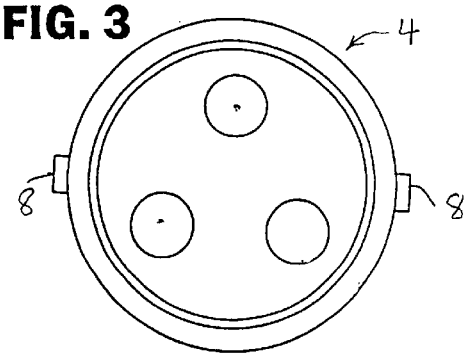
FIG.4
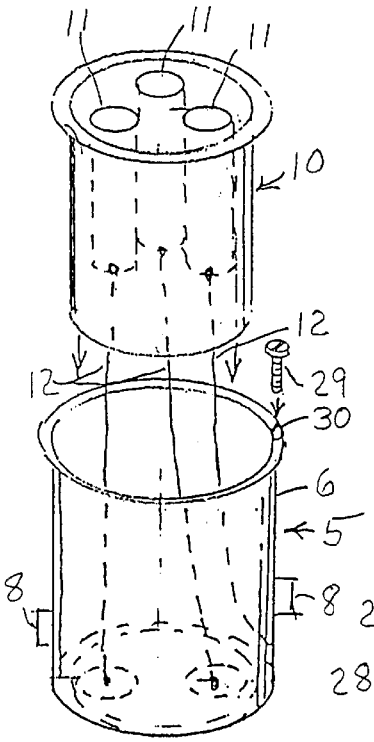
FIG. 5
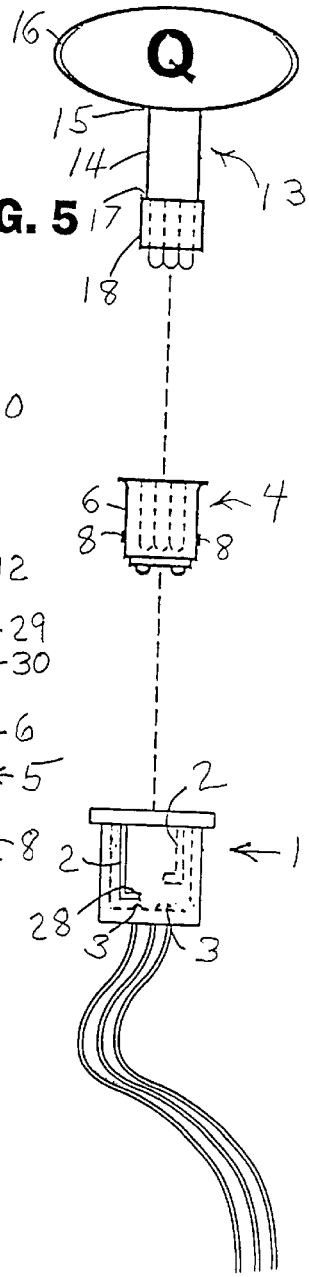

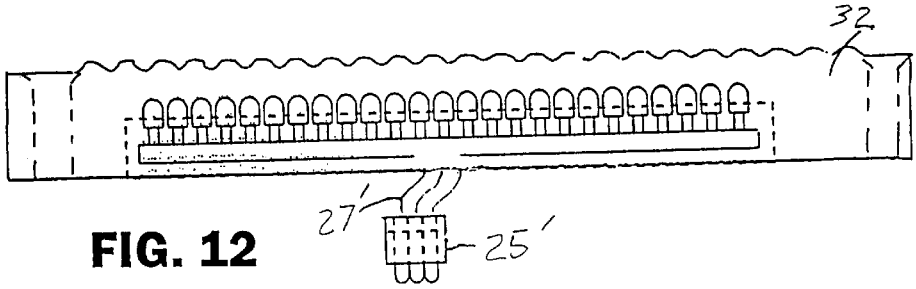
FIG. 12
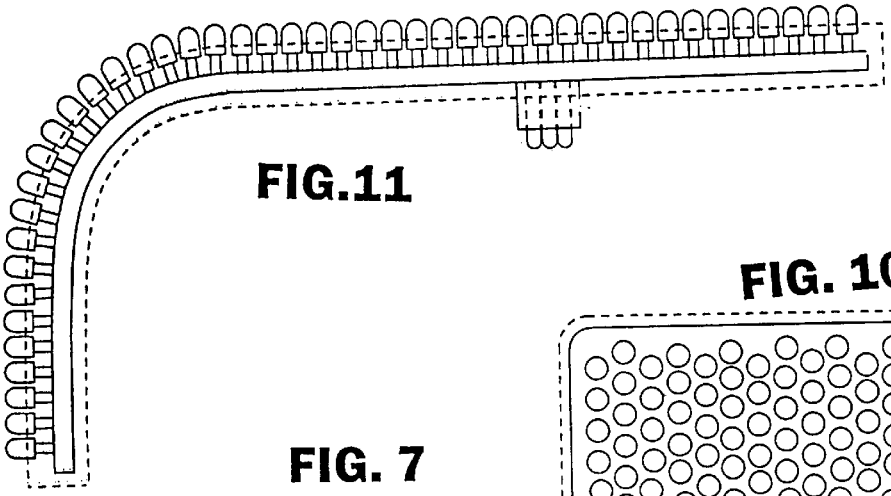
FIG.11
FIG. 10
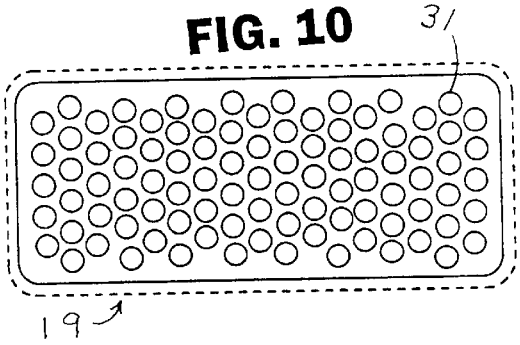
FIG. 7
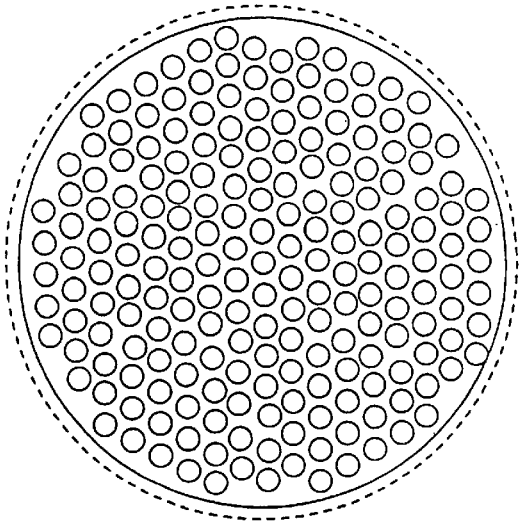
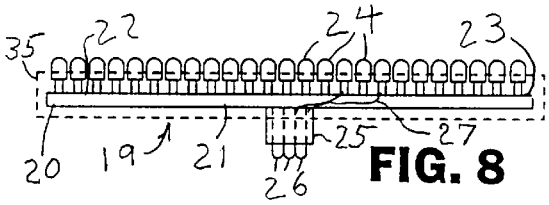
FIG. 8
FIG. 9
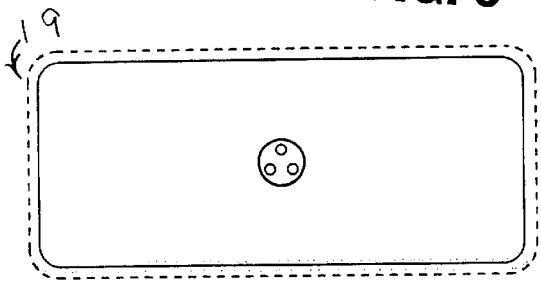
FIG. 6
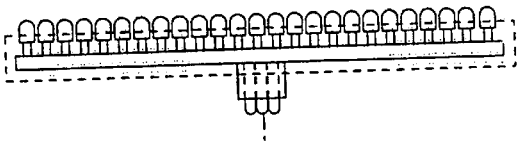

LED VEHICULAR LIGHTS AND CONNECTORS THEREFOR

BACKGROUND OF THE INVENTION

This invention relates to external vehicle LED lights and electrical connectors connecting the lights to the bayonet sockets ordinarily found in the vehicles for connecting to incandescent bulbs with bayonet bases.

DESCRIPTION OF THE PRIOR ART

Motor vehicles have tail lights, stop lights, back-up lights, and the like. They generally have external lenses securely fastened in place. In the case of stop and tail lights, these are red. Behind the lens is mounted one or more light bulbs. These may be incandescent bulbs with one or more filaments. The bulb is held fixedly in correct operating position by its socket, which is a bayonet socket securely mounted and grounded to the vehicle. These are well known in the art. They require the bulb to be inserted forcefully by translation and then rotated. This ensures good electrical contact, correct contact registration in the case of multiple filaments, and secure holding against vibration. Incandescent bulbs have a short life and draw too much current, since much of the power is used as heat, not light. Even the light emitted is mostly wasted, since all but the desired color is removed by the lens/filter. On the other hand, light emitting diodes convert almost all of the electrical energy into light of the desired color. The labor costs of frequent bulb replacement are excessive. Furthermore, until the failed bulb is replaced, the vehicle is unsafe. U.S. Pat. No. 5,594,433 issued Jan. 14, 1997 to Terlep discloses a pair of LED's mounted on a bayonet base. The assembly must be pushed into the bayonet socket and then rotated with considerable torque. There must be sufficient clearance in the mounting space for this maneuver, and strength in the assembly to resist the torque required. Commercially available LED lamp assemblies for replacement of vehicle lights are provided by ROMA INTERNATIONAL INDUSTRIES of Miami, Fla. They all terminate in connectors that operate by simple translation. They all have molded on external lenses, by which they are held in position on the vehicle. They cannot be used to replace a bayonet base bulb without rewiring, and disposal of the original lens.

SUMMARY OF THE INVENTION

It is accordingly an object of the invention to provide lights that have very long lives and draw much less current for an equivalent amount of light, namely light emitting diodes (LEDS). It is another object to provide such lights that can be used with existing bayonet sockets by means of a simple socket adapter. Since each LED emits a narrow beam of light, the LED light source will be comprised of a plurality of LED's distributed in a manner to emulate the light distribution of the light being replaced. It is yet another object that the combination of LED light assembly and adapter correctly position the light to facilitate conversion from the prior incandescent bulb. It is yet another object that the LED assembly optionally incorporate the external lens as well. It is yet another object that the light assembly optionally incorporate other electrically powered elements such as blinking lights, sound generators, and the like. These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 1 is a front elevation view of an adapter of the invention.

FIG. 2 is a side elevation view of the adapter of FIG. 1.

FIG. 3 is a top view of the adapter of FIG. 1.

FIG. 4 is an exploded perspective view of the adapter of FIG. 1.

FIG. 5 is a front elevation view of the installation tool of the invention in combination with the adapter and the bayonet socket into which the adapter is to be installed.

FIG. 6 is a front elevation view of a circular LED lamp assembly of the invention.

FIG. 7 is top view of the lamp assembly of FIG. 6.

FIG. 8 is a front elevation view of a rectangular LED lamp assembly of the invention.

FIG. 9 is a bottom view of the lamp assembly of FIG. 8.

FIG. 10 is a top view of the lamp assembly of FIG. 8.

FIG. 11 is a front elevation view of a non-planar LED lamp assembly of the invention.

FIG. 12 is a front elevation of an LED lamp assembly of the invention incorporating the external lens of the vehicle.

DETAILED DESCRIPTION OF PREFERRED EMBODIMENTS

Referring now to the drawing FIGS. 1–5, a motor vehicle will commonly have a plurality of bayonet sockets 1 rigidly mounted to the body for holding incandescent light bulbs for stop, tail, back-up, and turn signal lights. The socket is a conductive brass shell electrically grounded to the body. Parallel slots 2 terminate in transverse arcs 28. They are designed to receive and tightly hold opposed pins on the base of a bulb to make one contact by first translation motion followed by rotation into the arcs. One or more electrical contacts on the base of the bulb then register with electrical contacts 3 on the socket. The pins only fit the socket in one position to ensure correct registration. The multiple contacts are connected to different filaments in the bulb so that one socket and bulb may serve multiple functions. The socket positions the bulb exactly relative to the external lens of the vehicle to ensure correct light output. As best seen in FIG. 5, the socket 1 on the vehicle (not shown) is converted to receive the lamp assembly of the invention by insertion of the adapter 4. This is simply achieved by first mounting the adapter on the installation tool 13 by translation onto the plug 18 on the second end 17 of shaft 14. The adapter is then inserted by translation into the socket 1 and rotated by handle 16 on the first end 15 of shaft 14 so that the pins 8 of the adapter 4 run down the slots 2 and into the transverse arcs 28. This ensures good electrical contact of the pins 8 of the adapter with the ground of the vehicle, and exact position of the lamp assembly relative to the socket 1 without rewiring. The tool 13 is removed by simply pulling it out in a straight motion.

As best seen in FIGS. 1–4, the adapter 4 is comprised of:

1) A male first portion 5, having a cylindrical conductive outer side wall 6 and an insulated end wall 7. Opposed conductive pins 8 extend radially from the wall 6. At least one electrical contact 9 extends from the end 7, adapted for contact with a corresponding at least one contact(s) 3 on the bayonet socket 1;
2) A female second portion 10, has a plurality of female springy electrical contact tubes 11 of the type well known in the art for securely engaging a male contact to ensure good electrical contact as well as vibration resistant physical holding by simple translation. Wires 12 connect each contact tube 11 of the second portion 10 with an electrical contact 9, or the outer side wall 6, of the first portion 5; and 3) The second portion 10 is fitted into the first portion 5 and either fixed in position, or provided with means for adjusting and then fixing the rotary position of the two portions relative to one another, such as by the set screw 29 that is received in the threaded aperture 30.

As best seen in FIGS. 8–10, the lamp assembly 19 of the invention comprises:

1) A housing 20, that includes a circuit board 23, to which are affixed a plurality of light emitting diodes (LED's) 24 so that light shines outwardly from a second face 22 of the housing;
2) A unitary electrical plug 25 affixed to the first face 21 of the housing and extending outwardly therefrom, the plug adapted for secure electrical connection of a plurality of contacts 26 therein by translation into the contacts 11 in the adapter 4; and
3) Electrical connections 27 between the plug 25 and the LED's. These connections may enable the assembly to illuminate certain of the LED's for one purpose, and other or all LED's for another purpose. An example would be where the assembly replaces a double filament bayonet base bulb for stop light and tail light;
4) As shown by the phantom lines 35, the assembly may be potted with a resin such as epoxy to make a secure composite; and
5) A piezoelectric sonic element 31 may be included on the assembly, such as for use when the assembly serves as a back-up light.

The assembly may take a variety of configurations to serve a variety of special purposes, such as the rectangular shape of FIG. 10, the round shape of FIG. 6, and the non-planar shape of FIG. 11.

As shown in FIG. 12, the assembly may incorporate the molded on external lens 32 so that the assembly may replace the vehicle's lens. In this application, it may be useful to have the plug 25' attached by flexible wires 27'.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. An LED light assembly and connection adapter for installation in the bayonet socket of a motor vehicle, the bayonet socket having electrically conductive side walls with parallel slots in the side walls extending parallel to the long axis of the socket, the slots terminating in transverse arcs, and at least one electrical contact at the base of the socket, the improvement comprising:

a) an adapter including:
  i) a male first portion having:
    a cylindrical side wall and an insulated end wall;
    a pair of opposed electrically conductive pins extending radially from the side wall adapted for insertion into the slots by first translation and then rotation for electrically engaging and holding onto the socket side walls;
    at least one electrical contact on the end wall adapted for electrically contacting the at least one electrical contact at the base of the socket;
  ii) a female second portion including:
    a plurality of contacts adapted for secure electrical connection by translation to a unitary plug;
    each of the contacts in the second portion being electrically connected either to one of the contacts in the end wall or to the pins;
b) a lamp assembly including:
  i) a housing having a first face and a second face;
  ii) an LED board assembly having a plurality of LED's fixedly mounted thereon in a predetermined distribution, the LED board assembly being mounted in the housing with the lights shining outwardly from the second face;
  iii) a unitary electrical plug attached by attachment means to the first face and extending outwardly therefrom, the unitary electrical plug being adapted for secure electrical connection of a plurality of contacts therein by translation into the female second portion of the adapter; and
  iiii) electrical connection between each of the contacts in the unitary plug and certain of the LED's for performing prescribed functions.

2. The improvement according to claim 1 further comprising:

a sonic element mounted on the LED board assembly connected to a contact on the plug for sounding an alarm in conjunction with a backup light on the board.

3. The improvement according to claim 1 further comprising means for adjusting the rotary angle of the first portion relative to the second portion of the adapter.

4. The improvement according to claim 1 further comprising an installation tool for inserting the adapter into the bayonet socket, the tool comprising:

a) an elongate shaft having first and second ends;
b) a handle at the first end for gripping and rotating;
c) a plug at the second end for secure insertion into the female second portion of the adapter with means for rotating the adapter within the bayonet socket.

5. The improvement according to claim 1 further comprising an external lens molded onto the second face of lamp assembly for mounting in place of the original vehicle lens.

6. The improvement according to claim 1 in which the attachment means is rigid.

7. The improvement according to claim 1 in which the attachment means is flexible.

8. A connection adapter system for installation in a bayonet socket, the bayonet socket having electrically conductive side walls with parallel slots in the side walls extending parallel to the long axis of the socket, the slots terminating in transverse arcs, and at least one electrical contact at the base of the socket, the adapter comprising:

i) a male first portion having:
  a cylindrical side wall and an insulated end wall;
  a pair of opposed electrically conductive pins extending radially from the side wall adapted for insertion into the slots by first translation and then rotation for electrically engaging and holding onto the socket side walls;
  at least one electrical contact on the end wall adapted for electrically contacting the at least one electrical contact at the base of the socket;
ii) a female second portion including:
  a plurality of contacts adapted for secure electrical connection by translation to a unitary plug; and each of the contacts in the second portion being electrically connected either to one of the contacts in the end wall or to the pins.

9. The connection adapter system according to claim 8 further comprising an installation tool for inserting the adapter into the bayonet socket, the tool comprising:

a) an elongate shaft having first and second ends;

b) a handle at the first end for gripping and rotating;

c) a plug at the second end for secure insertion into the female second portion of the adapter with means for rotating the adapter within the bayonet socket by rotation of the handle.

10. The improvement according to claim 9 further comprising means for adjusting the rotary of the first portion relative to the second portion of the adapter.

* * * * *

UNITED STATES PATENT AND TRADEMARK OFFICE

CERTIFICATE OF CORRECTION

PATENT NO. : 6,338,647 B1
DATED : January 15, 2002
INVENTOR(S) : Fernandez et al.

It is certified that error appears in the above-identified patent and that said Letters Patent is hereby corrected as shown below:

Title page,
Item [*] Notice, delete the phrase "by 0 days" and insert -- by 7 days --

Signed and Sealed this

Twenty-eighth Day of September, 2004

JON W. DUDAS
*Director of the United States Patent and Trademark Office*